US005683651A

United States Patent [19]

Nakamura

[11] Patent Number: 5,683,651

[45] Date of Patent: Nov. 4, 1997

[54] METHOD AND ASSEMBLY FOR SEALING UP THE ENTRANCE AND EXIT OF A HEAT-TREATING FURNACE OPERATED IN A GAS ATMOSPHERE CONTAINING HYDROGEN GAS

[75] Inventor: Teruhisa Nakamura, Shin Nanyo, Japan

[73] Assignee: Nisshin Steel Co., Ltd., Tokyo, Japan

[21] Appl. No.: 583,059

[22] PCT Filed: May 31, 1995

[86] PCT No.: PCT/JP95/01063

§ 371 Date: Jan. 19, 1996

§ 102(e) Date: Jan. 19, 1996

[87] PCT Pub. No.: WO95/33078

PCT Pub. Date: Dec. 7, 1995

[30] Foreign Application Priority Data

| | | | |
|---|---|---|---|
| Jun. 1, 1994 | [JP] | Japan | 6-140699 |
| Jun. 21, 1994 | [JP] | Japan | 6-160728 |
| Oct. 19, 1994 | [JP] | Japan | 6-278641 |
| Oct. 21, 1994 | [JP] | Japan | 6-281488 |

[51] Int. Cl.[6] ..... C21D 1/74

[52] U.S. Cl. ..... 266/44; 266/110

[58] Field of Search ..... 266/249, 252, 266/102, 103, 108, 110, 44

[56] References Cited

U.S. PATENT DOCUMENTS

| | | | |
|---|---|---|---|
| 890,252 | 6/1908 | Thompson | 266/110 |
| 890,314 | 6/1908 | Thompson | 266/110 |
| 3,291,468 | 12/1966 | Albertsen et al. | 266/110 |

FOREIGN PATENT DOCUMENTS 47-25762 8/1972 Japan .

*Primary Examiner*—Scott Kastler

*Attorney, Agent, or Firm*—Kanesaka & Takeuchi

[57] ABSTRACT

A seal assembly of the invention located on entrance and exit sides of a heat treating furnace for a metallic strip. The seal assembly is formed of a housing having a furnace wall and a side plate, a seal sheet fixed at one end to the side plate and supported in place with flexibility, an elastic seal pad fixed to a surface of the seal sheet, and an elastic rotating roll held by the furnace wall at longitudinal ends and pressed against the elastic seal pad and a metallic strip to be treated. The elastic seal pad has a surface formed of a material with a limit oxygen index LOI of 26 or more and a hardness of 10 to 50 as measured according to JIS S6050. Also, a plurality of pressure applying mechanisms is attached to the side plate. Each pressure applying mechanism includes a holder fixed to each sleeve of the furnace wall, a pressure applying member situated in the holder to apply pressure to the seal sheet in the furnace, a coil spring situated in the holder for urging the pressure applying member to the furnace, and a bolt threadably engaging a thread of the holder for urging the coil spring toward the furnace. The elastic seal pad can closely contact the elastic rotating roll by the plurality of pressure applying mechanisms.

20 Claims, 8 Drawing Sheets

METHOD AND ASSEMBLY FOR SEALING UP THE ENTRANCE AND EXIT OF A HEAT-TREATING FURNACE OPERATED IN A GAS ATMOSPHERE CONTAINING HYDROGEN GAS

TECHNICAL FIELD

The present invention relates to a method for sealing up the entrance and exit of a heat-treating furnace operated in a reducing gas atmosphere including hydrogen gas, wherein metallic strips such as stainless steel strips are annealed or subjected to strain relieving annealing with no oxide coating formed on the surface thereof, and an assembly well suited for carrying out this method.

BACKGROUND TECHNIQUE

Metallic strips, for instance, stainless steel strips are subjected to bright annealing or strain relieving annealing in a heat-treating furnace wherein they are heat treated with no oxide coating formed on the surfaces thereof. Fed to this heat-treating furnace is an inflammable, reducing gas atmosphere including hydrogen gas such as a mixed gas consisting of 75% of hydrogen gas and 25% of nitrogen gas (which will hereinafter be simply called the furnace gas).

Seal assemblies (or seals) for shielding the furnace gas from the outside air are located at portions of the entrance and exit, through which the metallic strip that is to be treated and has been treated is passed, of a heat-treating furnace to which the furnace gas is fed (hereinafter may be called seals). Typical example of such seal assemblies is shown in Japanese Patent Publication No. 42-18893. The seal disclosed therein is made up of a pair of elastic rotating rolls with the metallic strip held therebetween, which rotate at a speed substantially equal to the speed of movement of the metallic strip, and a pad formed of felt for making a seal between a flexible seal sheet (which will hereinafter be called the elastic seal pad) fixed at one end to the furnace body and said elastic rotating rolls.

One example of a conventional heat-treating furnace using the furnace gas will now be explained with reference to a general shaft type of bright annealing furnace for stainless steel strips.

FIG. 8 illustrates the general structure of a bright annealing furnace for stainless steel strips. A metallic strip S consisting of a stainless steel strip is guided by a deflector roll and fed into a furnace body 1 through a seal assembly 2' located on the entrance side, wherein the strip is heated to a given temperature and then cooled. Upon leaving the furnace body, the strip is guided by a seal assembly 2' located on the exit side. Prevailing within the furnace body 1 is constantly an inflammable furnace gas containing hydrogen gas such as one mentioned as above, so that the furnace pressure is kept about 10 to 50 mm $H_2O$ higher than the outside air pressure. In this arrangement, the furnace gas is allowed to leak little by little through the seal assemblies 2' and 2' located on the entrance and exit sides, thereby foreclosing the possibility that the air (oxygen) may enter the furnace body 1 and mixed with the furnace gas.

FIG. 9 is an enlarged front view of the conventional seal assembly located on the exit side, and FIG. 10 is an enlarged partial side view thereof. In this conventional seal assembly 2', elastic seal pad 5' formed of felt or a felt equivalent is fixed by an adhesive or a combined bolt and nut clamping means to the surface of a seal sheet 4' fixed at one end to a side plate 3*a* of a furnace wall 3 of the furnace body 1. This seal sheet 4' is formed of a thin stainless sheet having a thickness of about 0.5 mm and having some spring action. Then, a piston rod 8*a* is driven by a cylinder of a mechanism 8 for moving elastic rotating rolls 6' and 6' away from or toward each other, so that the elastic rotating roll 6' can be engaged with the metallic strip S and the elastic seal pad 5' to seal the interior of the furnace 1 against the outside air.

Here, the mechanism 8 for moving elastic rotating rolls 6' and 6' away from or toward each other so that the elastic rotating roll 6' can be engaged with the metallic strip S and the elastic seal pad 5' fixed to the surface of the seal sheet 4' fixed at one end to the side plate 3*a* of the furnace wall 3 of the furnace body 1 will briefly be explained with reference to FIGS. 9 and 10. A lever 8*b*, which is pivotally mounted on a fixed pin 8*c* on which the lever 8*b* is pivoted, has at its distal end a bearing 6*f* for supporting a roll shaft 6*e'* of the elastic rotating roll 6' and receives at the proximal end the working force of the piston rod 8*a* driven by a cylinder. A pair of elastic rotating rolls 6' and 6' is engaged with the metallic strip S while it is passing between the rolls and, at the same time, is engaged with the elastic seal pads 5' and 5' fixed to the seal sheet 4', so that the furnace body 1 can be shielded from the outside air to keep the furnace sealed up. Since the elastic rotating rolls 6' have a drum length larger than the width of the metallic strip S, it is unlikely that a gap corresponding to the thickness of the metallic strip S may be formed on both widthwise sides of the metallic strip S due to the elasticity of the elastic rotating rolls 6'.

With the cylinder of the mechanism 8 for moving the rolls away from or toward each other driven to apply working force on the piston rod 8*a*, the two elastic rotating rolls 6' are engaged with the metallic strip S passing between the rolls and, at the same time, are engaged with the elastic seal pads 5' fixed to the seal sheets 4'. However, when the conventional seal assemblies 2' are used in such a way that between the elastic rotating rolls 6' and the elastic seal pads 5' there are large frictional forces generated by the seal sheets 4' having spring actions on engaging the elastic seal pads 5' with the elastic rotating rolls 6', the soft surfaces of the elastic rotating rolls 6' are injured by the elastic seal pads 5' or worn away by friction, because the elastic rotating rolls 6' have a decreased hardness so as to achieve an improved sealing effect. Besides, the surfaces of the elastic seal pads 5' are fuzzed up due to friction with the elastic rotating rolls 6'. The resulting fuzz is then transferred onto the metallic strip S which, if rolled as such, will be degraded in terms of surface properties. Therefore, such seal sheets 4' must be formed of very thin sheets of stainless steel or so on, which have reduced spring actions and so produce low pressure. However, much difficulty is involved in making the pressure of contact of the elastic rotating rolls 6' with the elastic seal pads 5' uniform along the full lengths of the elastic rotating rolls 6', because the elastic seal pads 5' have originally no high dimensional precision unlike machined products. As a result, the furnace gas leaks heavily from portions having a low pressure of contact of the elastic rotating rolls 6' with the elastic seal pads 5'.

The two elastic rotating rolls 6' are designed to have a reduced hardness so as to achieve an improved sealing effect. Thus, portions of consistent contact of the elastic rotating rolls 6' with sharp edges of the metallic strip S passing between them are heavily worn away or injured, and so reduced in diameter, as shown in FIG. 11. These worn or injured portions (hereinafter called simply the worn portions) define a gap with the metallic strip S, from which the furnace gas often leaks heavily.

Heavy furnace gas leakage from specific portions is likely to cause fires by the ignition of a furnace gas mixture with air around the seal assemblies 2' by heated refractory or brick debris and high-temperature debris stripped off the metallic strip which is being heat treated, and carried out of the furnace by the seal assembly 2', or sparks generated by static electricity due the friction of the elastic rotating rolls 6' with the elastic seal pads 5'. The reason is that the furnace gas is a gas mixture containing inflammable hydrogen gas.

Such fires, if caused, may be put out within a relatively short period of time of about 10 seconds by injecting nitrogen gas into the inner portions of the furnace of the seal assemblies 2', or using an extinguisher added to seal assemblies 2' to inject nitrogen gas into the sealed portion, or spraying carbonic acid gas onto the seal assemblies 2'. However, the elastic seal pads 5' and elastic rotating rolls 6' forming the seal assemblies 2' lose elasticity and sealing properties upon injured by the generated hydrogen gas flames of high temperature. It is not preferable to form the elastic seal pads 5' of wool felt alone for the following reasons. Wool felt, if it has elasticity, is improved in terms of air permeability but becomes insufficient or useless in terms of sealing properties. On the other hand, if wool felt is compressed so as to improve sealing properties, it decreases in elasticity and loses surface softness. Consequently, it damages, or abrades, the surfaces of the elastic rotating rolls 6' by rotational sliding movement, and loses flexibility enough to follow the surface asperities of the rolls, resulting in a lowering of the sealing effect. It is not preferable that, it is fuzzed up, fur comes off and abrasion is likely to be caused. Fuzzing makes sealing properties worse, and fur, if deposited to the metallic strip S, will cause the metallic strip S to have a dent form of defects upon rolled at the next step. To eliminate such problems and in view of the fuzzing, coming-off-of-fur, sealing properties, surface softness, flexibility of the pad itself, wear resistance and quality stabilization of the elastic seal pads 5', it has been proposed to laminate polyester or acrylic fiber felt to the surface of wool felt. However, not only are these fibers low in melting and softening points, but they have also a reduced limit oxygen index LOI (an index to the minimum oxygen volume fraction required for fibers to maintain burning), as can be seen from FIG. 7 showing the LOIs of various materials. That is, they have the nature of keeping burning in the air outside the furnace because the air contains oxygen. On fire, they are melted even within a time as short as about 10 seconds, and the melt is deposited to the elastic rotating rolls 6', so doing damage to the elastic rotating rolls 6'. The damage is then often transferred to the metallic strip S. Thus, the elastic seal pads 6' are less effective or ineffective for sealing purposes.

Such heavy furnace gas leakage from specific portions may be prevented by engaging the elastic rotating rolls 6' tightly with the metallic strip S to seal up a gap produced by wearing, if only the elastic rotating rolls 6' and metallic strip S are taken into account. However, if the elastic rotating rolls 6' and elastic seal pads 5', too, are taken into consideration, the rolls 6' decrease in diameter so that the diameter becomes smaller than other portions; so between the elastic rotating rolls 6' and the elastic seal pads 5' there are formed gaps, and this makes the sealing properties worse. Since the elastic seal pads 5' are formed as of a material such as felt and so have some elasticity, their sealing effect may be well kept if high pressure is generally applied thereto. However, the application of pressure to unnecessary portions of the elastic seal pads 5' damages the soft surfaces of the elastic rotating rolls 6'. Besides, there is an increase in the resistance to rotation of the elastic rotating rolls 6', which has an adverse influence on tension control of the metallic strip S in the furnace. In some cases, the rotatory forces of the elastic rotating rolls 6' are consumed by their frictional resistance with the elastic seal pads 5', so making the torque to the elastic rotating roll 6' too insufficient to prevent slippage of the metallic strip S from the surfaces of the elastic rotating rolls 6', resulting in damage to the surface of the metallic strip S.

When a thick metallic strip S is passed between the elastic rotating rolls 6', gaps are produced between the elastic rotating rolls 6' and edge portions of the metallic strip S, if the pressure of the elastic rotating rolls 6' to the metallic strip S is high. To prevent this, applicant has already proposed to use an elastic rotating roll 6' with the drum having a middle portion of small diameter, tapered portions of transition diameter and end portions of large diameter, unlike the conventional flat roll (see Japanese Patent Laid-Open No. 2-54723). With such an elastic rotating roll 6' with the drum of different diameters, it is possible to lower the pressure applied to the metallic strip S yet to enhance the sealing effect. To make the widthwise shape of an associated elastic seal pad 5' conform to the drum shape of the elastic rotating roll 6 to impart sufficient elasticity to the elastic seal pad and to achieve the proper engagement of the elastic rotating roll 6' with the elastic seal pad at the portions of varying diameters, thereby preventing furnace gas leakage from a portion of contact of the elastic rotating roll 6' with the elastic seal pad 5', the pressure of the elastic seal pad 5' to the elastic rotating roll 6' must be slightly high.

DISCLOSURE OF THE INVENTION

In view of the above problems associated with the prior art, an object of the present invention is to provide a method for sealing up a heat treating furnace with an inflammable furnace gas which uses atmosphere gas containing hydrogen gas for a seal assembly located on the entrance and exit sides thereof, wherein the amount of furnace gas leakage from between an elastic seal pad and an elastic rotating roll can be reduced as much as possible. Another object of the present invention is to provide a seal assembly best suited for carrying out this seal method. A further object of the present invention is to provide a seal assembly that can not only provide a stable sealing of a heat treating furnace over an extended period, but also can well seal up the furnace without reducing the sealing properties even when a small fire is caused in the vicinity thereof.

The present inventor has made an intensive study to solve such problems as mentioned above and achieved the present invention by the provision of a method for sealing up the entrance and exit of a heat treating furnace wherein a gas atmosphere containing hydrogen gas is used as a furnace gas using a seal assembly which is located on the entrance and exit sides of said heat treating furnace and including: a seal sheet fixed at one end to a side plate of a furnace wall and supported in place with flexibility; an elastic seal pad fixed to the surface of said seal sheet; and an elastic rotating roll held by said furnace wall positioned on both widthwise sides of a metallic strip to be fed out, and pressed against said elastic seal pad and said metallic strip to prevent gas leakage, in which a plurality of pressure applying mechanisms are provided, each operable on the outside of said side plate of said furnace wall to allow a pressure applying member of said pressure applying mechanism to apply pressure from within said furnace to said elastic seal pad through said seal sheet so that only the required portion of said elastic seal pad can be urged toward said elastic rotating roll, whereby only a gas leakage portion between said elastic seal pad and said elastic rotating roll is exclusively sealed up, so that the amount of furnace gas leakage can be reduced as much as possible.

If the surface of the above elastic seal pad is formed of a material having a limit oxygen index (an index to the minimum oxygen volume factor required for fibers to keep burning) LOI of 26 or more, the heat resistance of the elastic seal pad and elastic rotating roll in the seal assembly is improved so that the heat treating furnace can be stably sealed up over an extended period, and can be well sealed up as well without reducing sealing properties, even when a small fire is set on in the vicinity thereof.

BRIEF DESCRIPTION OF THE DRAWINGS

The seal method and assembly for sealing up the entrance and exit of a heat treating furnace with a gas atmosphere containing hydrogen gas prevailing therein will now be explained at great length with reference to the accompanying drawings, in which.

BEST MODE FOR CARRYING OUT THE INVENTION

Figure 1:
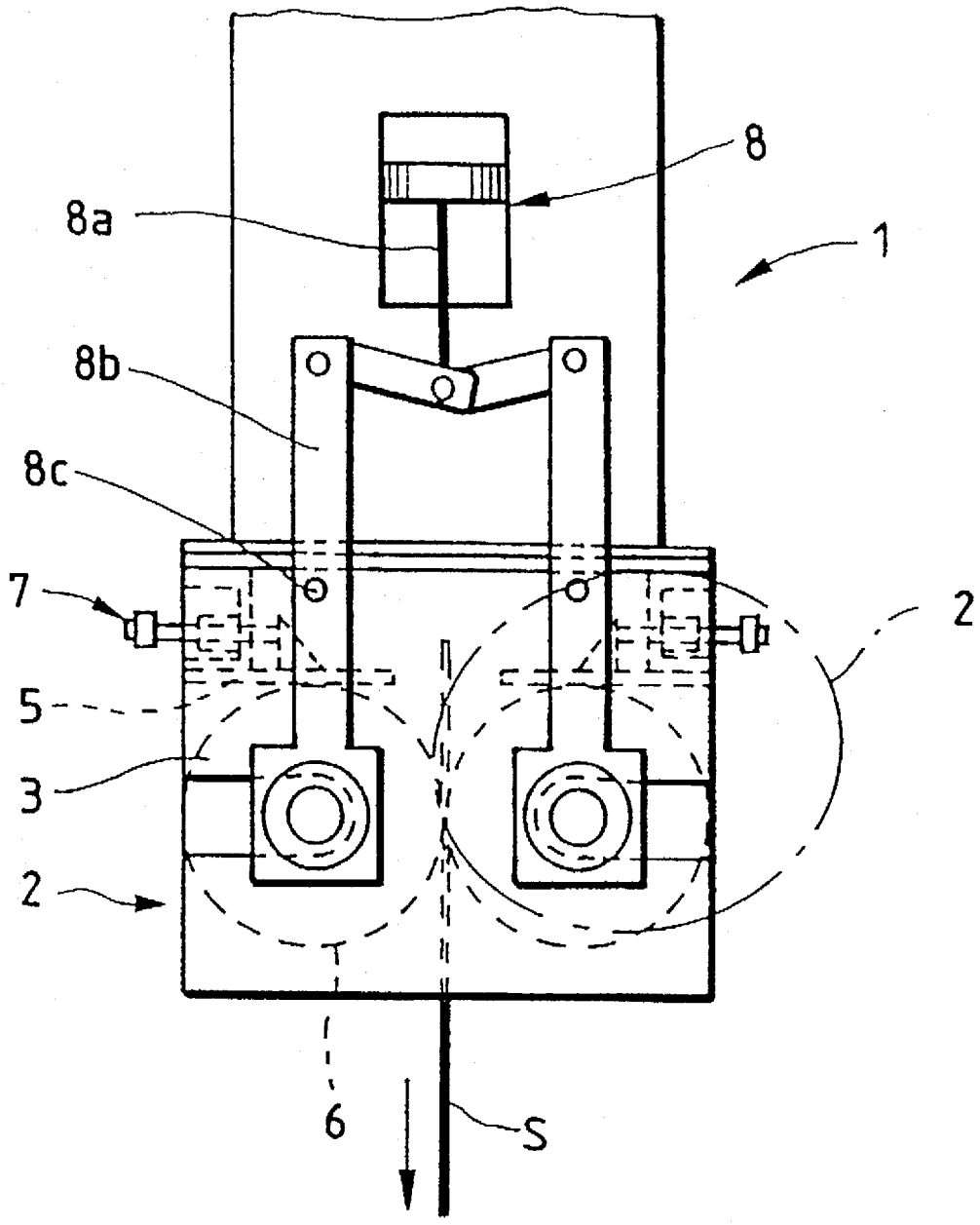
FIG. 1 is a front view of one embodiment of the present assembly for carrying out the present method, which is located on the exit side of a bright annealing furnace.

Referring now to the drawings, there is shown a furnace body 1 for heat treating a metallic strip S, such as a stainless steel strip with no oxide coating formed on the surface thereof for the purpose of annealing or strain relieving annealing, wherein an inflammable reducing gas atmosphere containing hydrogen gas is prevailing as the furnace gas. Thus, the furnace gas is fed into the furnace body 1 so that the interior of the furnace body 1 can be kept about 10 to 50 mm $H_2O$ higher than the outside air pressure.

Seal assemblies 2 of the present invention are used in association with the heat-treating furnace having the hydrogen gas-containing atmosphere prevailing therein, one assembly located on the entrance side and the other on the exit side. The seal assembly 2 includes: a seal sheet 4 fixed at one end to a side plate 3*a* of a furnace wall 3 and supported in place with flexibility, which is formed of a thin sheet of about 0.5 mm in thickness and having some spring action, this thin sheet, for instance, being formed of stainless steel or synthetic resin such as vinyl chloride; an elastic seal pad 5 fixed to the surface of the seal sheet 4 by an adhesive or a combined bolt and nut clamping means; an elastic rotating roll 6 held by the furnace wall 3 located on both widthwise sides of the metallic strip S to be fed out, so that it can be engaged with the elastic seal pad 5 and the metallic strip S to prevent furnace gas leakage.

Figure 3:
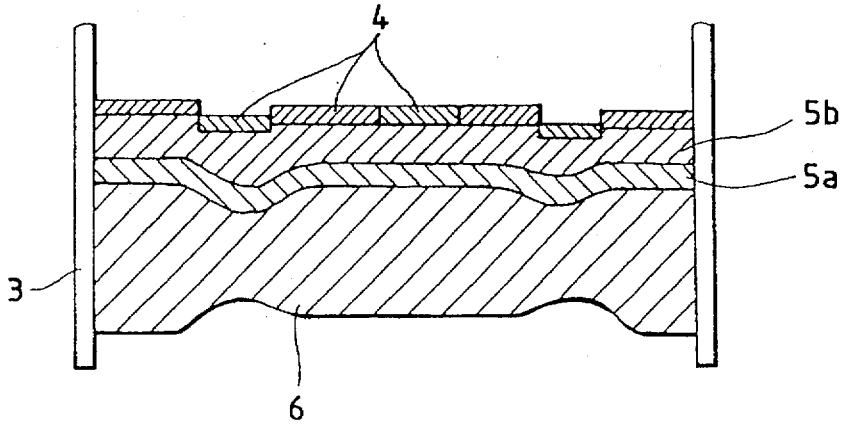
FIG. 3 is an enlarged sectional illustration taken along the line 3—3 in FIG. 2.

As mentioned just above, the seal sheet 4 is fixed to the side plate 3*a* of the furnace wall 3 and supported in place with flexibility. In one preferable embodiment, this sheet may be formed of a single thin sheet of metal or synthetic resin with no slit or cut-through section in the direction perpendicular to the axial direction of the elastic rotating roll 6. In another embodiment shown in FIG. 3, the side of the seal sheet 4 having an integrally continuous structure at one end that applies pressure to the elastic rotating roll 6 through the elastic seal pad 5 may be divided by providing slits in the direction perpendicular to the axial direction of the elastic rotating roll 6 corresponding to each of the pressure applying mechanisms 7 to be described later. In this example, however, the seal sheet 4 has an integrally continuous structure at one end. In still another embodiment, the side of the seal sheet 4 that includes the end fixed to the side plate 3*a* of the furnace wall 3 and applies pressure to the elastic rotating roll 6 through the elastic seal pad 5 may be cut through in section in the direction perpendicular to the axial direction of the elastic rotating roll 6 corresponding to each pressure applying mechanism 7.

Figure 2:
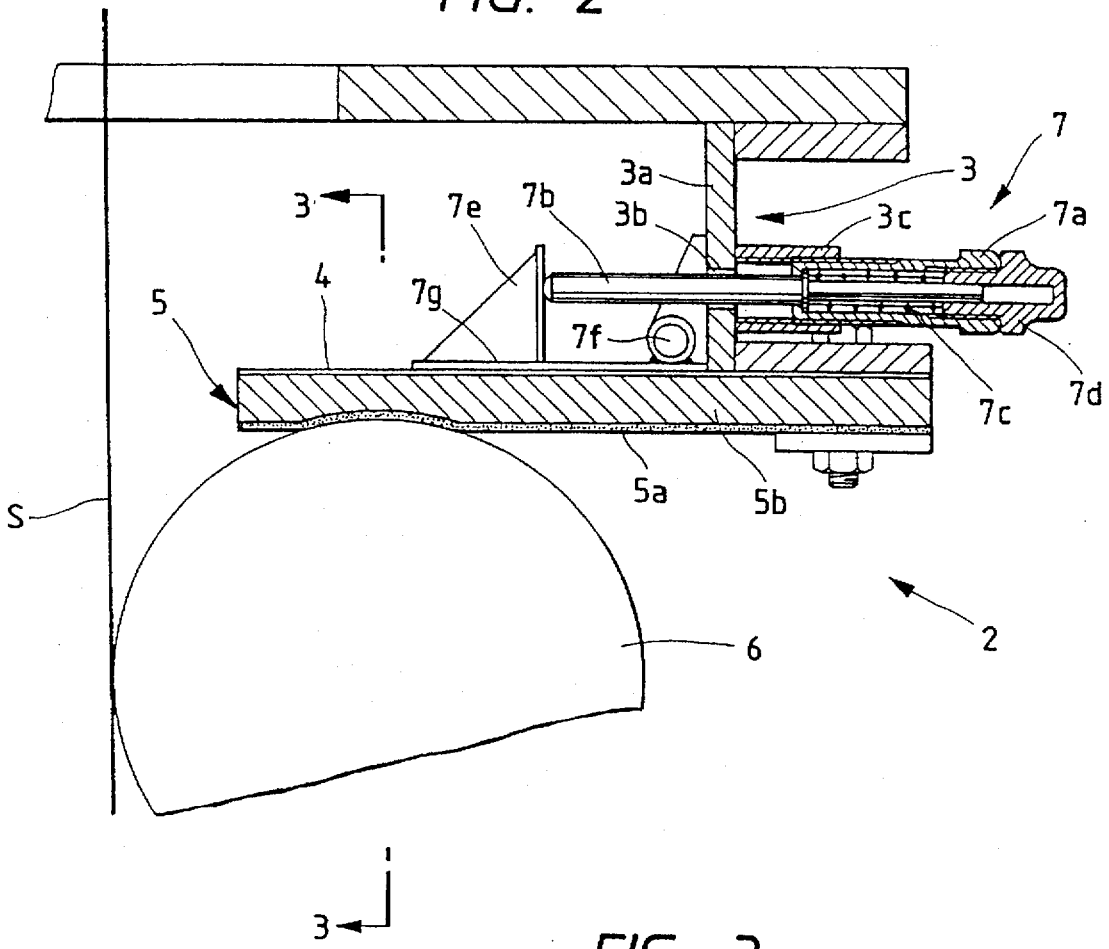
FIG. 2 is an enlarged sectional illustration of the encircled portion 2 in FIG. 1.

In one preferable embodiment, the elastic seal pad 5 may have a uniform thickness as shown in FIG. 2. In another preferable embodiment shown in FIG. 4, the elastic seal pad 5 may vary locally in thickness so as to increase the surface length of contact thereof with the elastic rotating roll 6. In either embodiment, it is preferable that the elastic seal pad 5 includes a segment having a radius of curvature substantially equal to the diameter of the drum of the elastic rotating roll 6, with the portion of contact of the segment with the elastic rotating roll 6 being 1/15 or longer of the peripheral length of the elastic rotating roll 6. This is because the length of contact of the elastic seal pad 5 with the periphery of the elastic rotating roll 6 is so increased that the furnace sealing effect can be enhanced owing to an increased flow resistance of the furnace gas. In the arrangement shown in FIG. 4, the elastic seal pad 5 has a relatively large thickness and so possesses rigidity by itself. To transmit the force of each pressure applying mechanism 7 easily and properly to the elastic seal pad 5, therefore, it is preferable that the side of the seal sheet 4 that applies pressure to the elastic rotating roll 6 is slit or cut through in section in the direction perpendicular to the axial direction of the elastic rotating roll 6 corresponding to each pressure applying mechanism 7.

The elastic seal pad 5 fixed to the surface of the seal sheet 4 is made of an elastic material. Since this elastic seal pad 5 will be exposed to flames on fire, at least its surface layer portion should preferable be made of a material having a limit oxygen index (LOI) of 26 or more, in another parlance, conforming to the requirement that the minimum oxygen volume fraction required for fibers to maintain combustion is 26% or more. To be specific, it is preferable that the elastic seal pad 5 is made up of a substantial portion 5*b* and a surface layer portion 5a laminated or otherwise integrally applied thereto. In this case, the substantial portion 5b comprises various sponges having a hardness of 10 to 50 as measured according to JIS S6050 such as NBR sponge, EPDM sponge, chloroprene rubber sponge, chlorosulfonated polyethylene sponge, chlorinated polyethylene sponge, hydrin rubber sponge, silicone rubber sponge, or a fluororubber sponge. The surface layer portion 5a, with which the elastic rotating roll 6 is to come into rotating and sliding contact, is made of a non-woven fabric comprising polyphenylene sulfide fibers, aramid fibers, aramid and carbon fibers, polyphenylene sulfide and aramid fibers, or polyphenylene sulfide, aramid and carbon fibers. Optionally, the non-woven fabric 5a comprising polyphenylene sulfide fibers, aramid fibers, aramid and carbon fibers, polyphenylene sulfide and aramid fibers, or polyphenylene sulfide, aramid and carbon fibers may be directly fixed to the surface of the seal sheet 4 to reduce its permeability.

In the present invention, the above two arrangments may be used. In the former arrangement, it is preferable that the substantial portion 5b of the elastic seal pad 5 is made of NBR sponge, EPDM sponge, chloroprene rubber sponge, chloro-sulfonated polyethylene sponge, chlorinated polyethylene sponge, hydrin rubber sponge, silicone rubber sponge, or a fluororubber sponge. Since the surface layer portion of the seal pad 5 is protected by heat-resistant fibers, this seal pad arrangement is greatly resistant to flames and stands well up to a small fire. Most preferably, the substantial portion should be made of a closed-cell sponge of less air permeability, because this sponge prevents furnace gas leakage.

Figure 4:
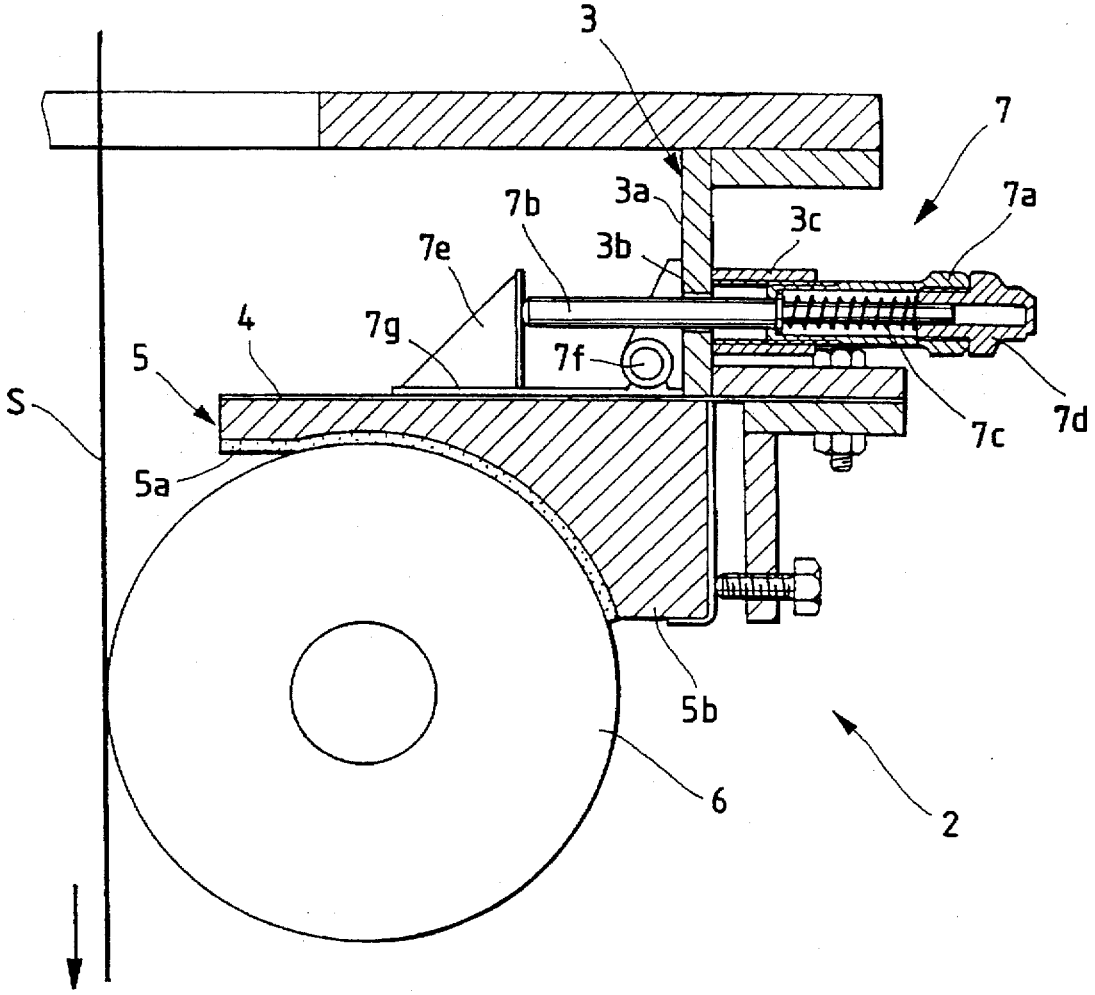
FIG. 4 is an enlarged sectional illustration, similar to FIG. 2, of another embodiment of the present assembly for carrying out the present method, which is located on the exit side of a bright annealing furnace.

Whether or not the side of the seal plate 4 of the substantial portion of the elastic seal pad 5 has NBR sponge, EPDM sponge, chloroprene rubber sponge, chlorosulfonated polyethylene sponge, chlorinated polyethylene sponge, hydrin rubber sponge, silicone rubber sponge, or a fluororubber sponge, it is preferable that the elastic seal pad 5 includes a segment having a radius of curvature substantially equal to the diameter of the drum of the elastic rotating roll 6, as shown in FIG. 4. This is because the length of contact of the elastic seal pad 5 with the periphery of the elastic rotating roll 6 is so increased that the furnace sealing effect can be enhanced owing to an increased flow resistance of the furnace gas. Furthermore, the surface layer portion 5a of the seal pad 5 is made of the non-woven fabric comprising the above fibers and so having minutes asperities on the surface, and functions as if it were a labyrinth packing, so that furnace gas leakage can be effectively prevented due to a large loss in gas pressure.

Figure 5:
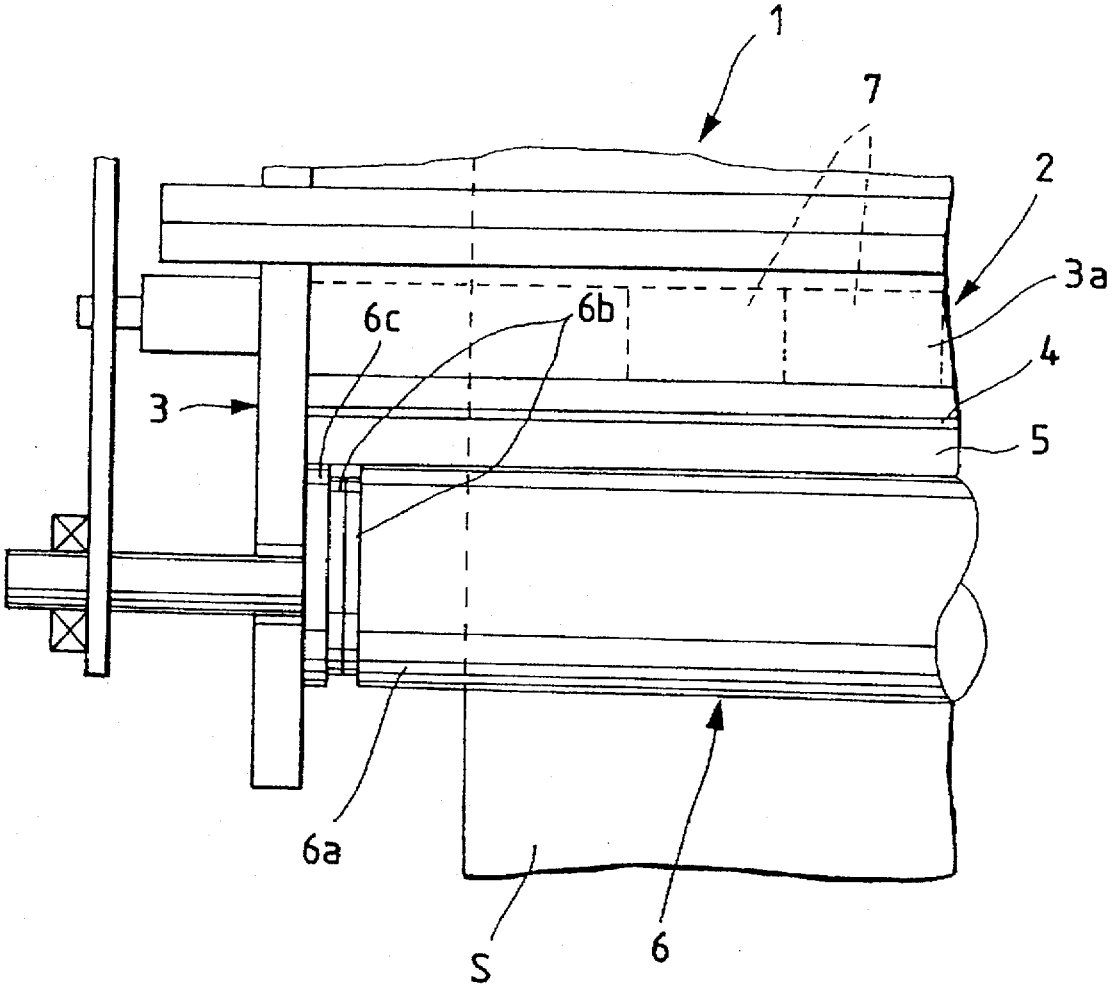
FIG. 5 is an enlarged side view of one embodiment of the end structure of one elastic rotating roll in the present assembly for carrying out the present method, which is located on the exit side of a bright annealing furnace.
Figure 6:
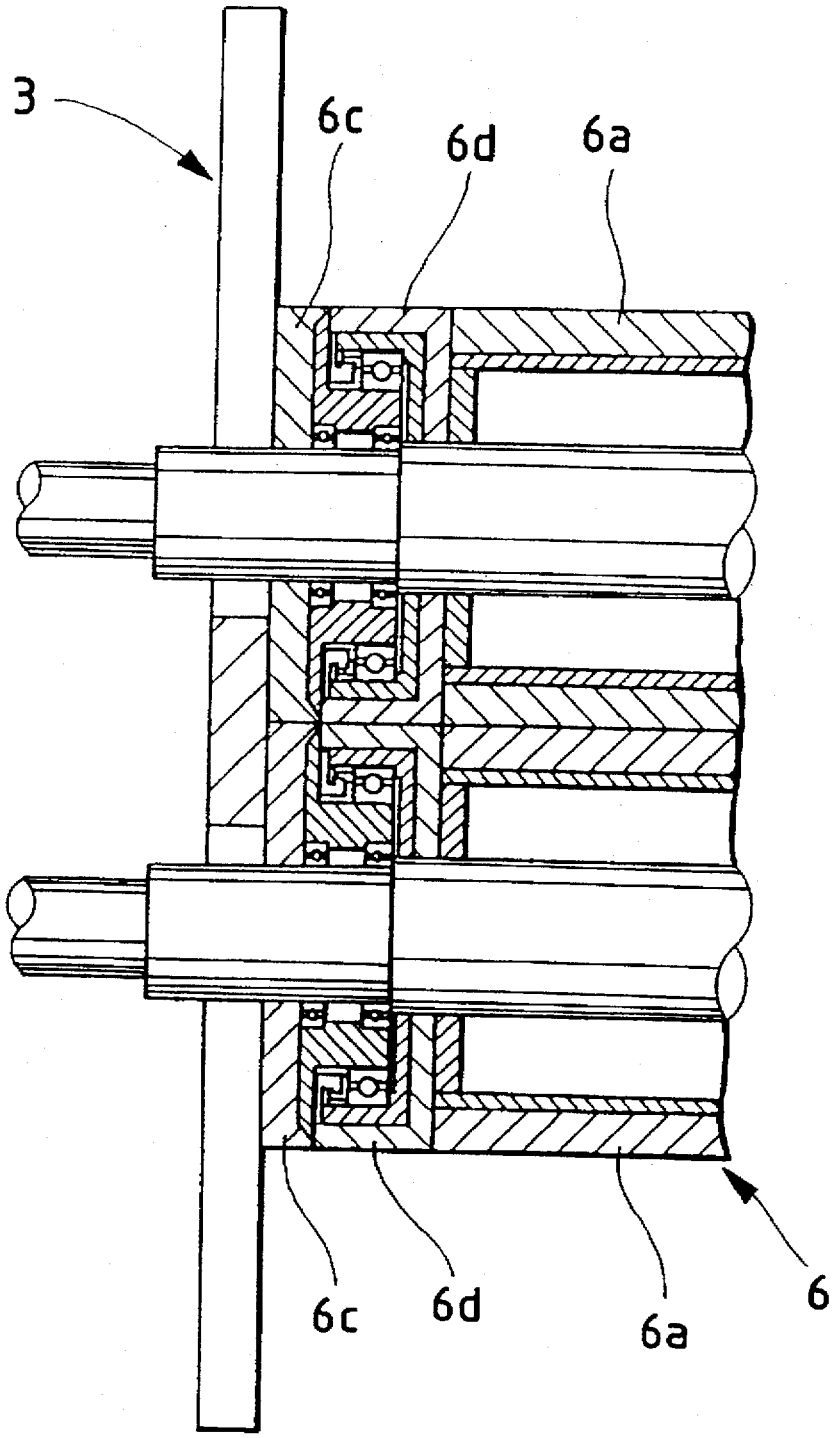
FIG. 6 is an enlarged sectional illustration of one embodiment of a rotating disk with a bearing, which is located between the drum portion of the elastic rotating roll and the both sides of furnace wall in the present assembly for carrying out the present method, which is located on the exit side of a bright annealing furnace.
Figure 7:
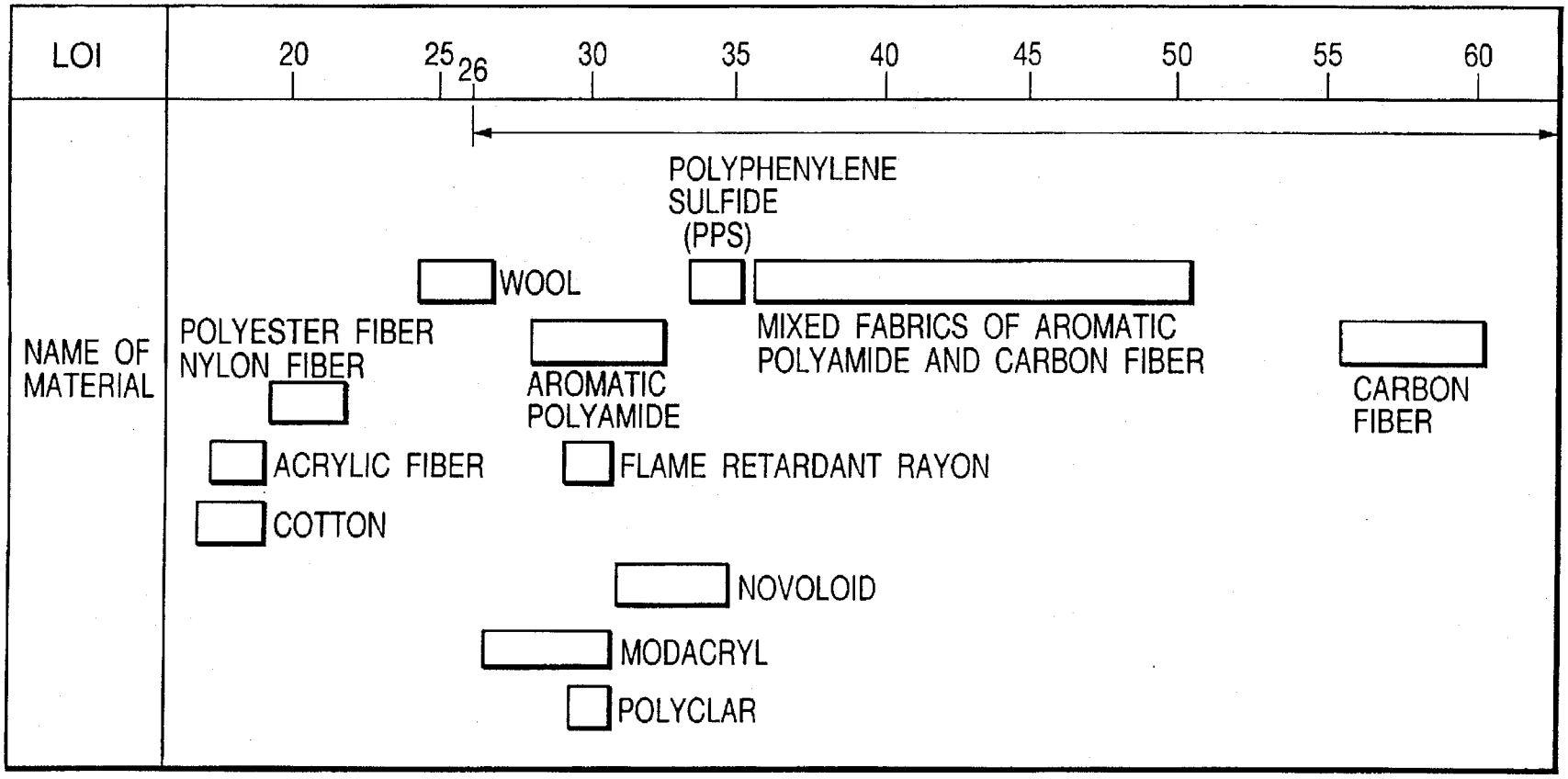
FIG. 7 is a graph for a reduced limit oxygen index to the minimum oxygen volume fraction required for fibers to maintain burning.
Figure 8:
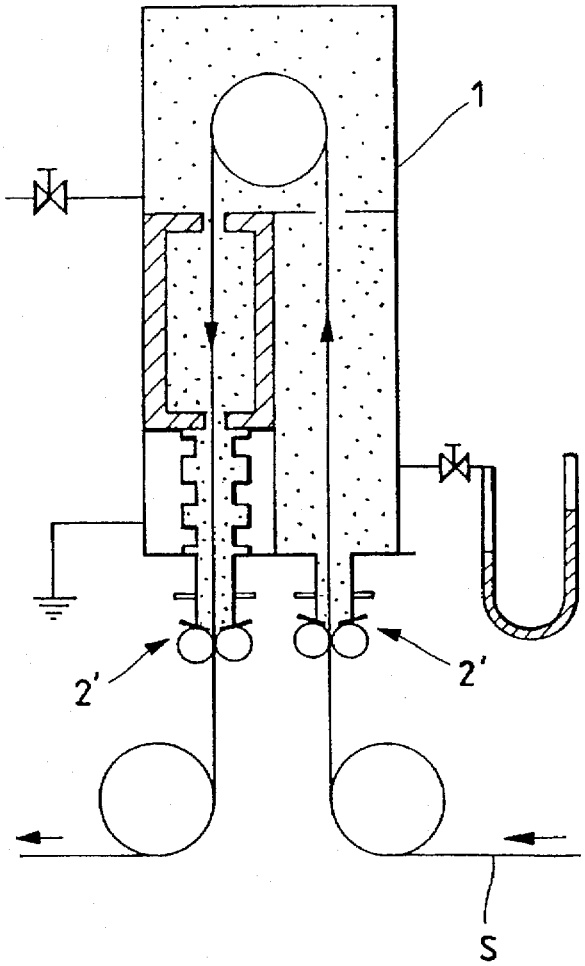
FIG. 8 is a general structure of a conventional bright annealing furnace for stainless steel strips.
Figure 9:
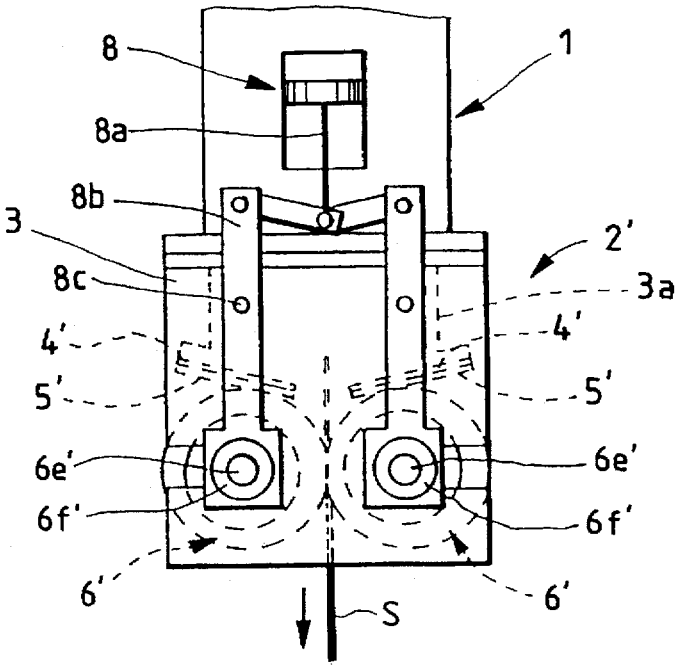
FIG. 9 is an enlarged front view of a conventional seal assembly.
Figure 10:
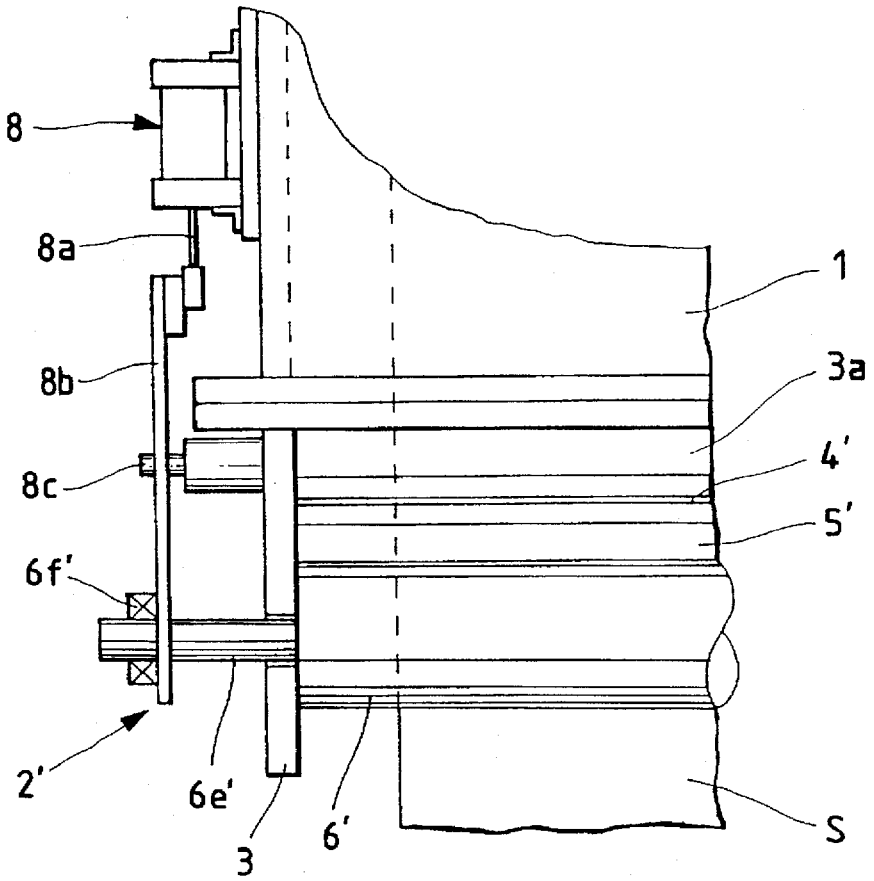
FIG. 10 is an enlarged partial side view of the seal assembly of FIG. 9.
Figure 11:
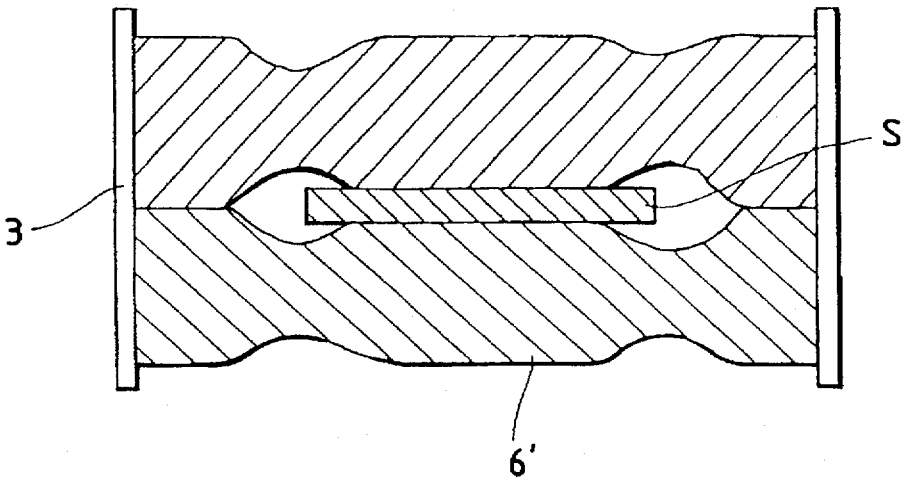
FIG. 11 is an explanatory view showing rotation rolls 6' with a metal strip S.

For the elastic rotating roll 6, it may be made of a roll built up of an elastic material such as silicone rubber, fluororubber, chloroprene rubber, chlorinated polyethylene, NBR, EPDM or urethane rubber and so allowed to have an elastic surface. Alternatively, a roll with the above-described elastic material attached to the surface of a metallic roll body may also be used. However, it is preferable that the outer surface of the drum portion 6a of the roll is made of chloroprene rubber, chlorosulfonated polyethylene, chlorinated polyethylene, hydrin rubber, silicone rubber or fluororubber, all well resistant to flames, with fire extinguishing means being additionally provided. These rubber materials suffer from no denaturalization on a small fire, and so offers no sealing problem. It is also preferable that at the end of the elastic rotating roll 6 and between both side ends of the drum portion 6a and the furnace wall 3 there are provided two or more slip disks 6b made of a synthetic material composed mainly of fluororesin well resistant to flames or heat and having a low coefficient of dynamic friction, as shown in FIG. 5, or alternatively, as shown in FIG. 6, there are provided a rotating disk 6d with a bearing, and an elastic disk 6c made of a material well resistant to flames such as chloroprene rubber, chlorosulfonated polyethylene, chlorinated polyethylene, hydrin rubber, silicone rubber or fluororubber, as in the case of the outer surface of the drum portion 6a of the roll. Then, the elastic disk 6c provides for sealing with a moderate resilient force while the transmission of rotatory force of the elastic rotating roll 6 to the furnace wall 3 is prevented by the slip disks 6b or the rotating disk 6d. This forecloses the possibility that the furnace wall 3 and/or the end of the drum portion 6a of the elastic rotating roll 6 wear away and so fail to provide for sufficient sealing, or are denatured, in a small fire.

A plurality of sets of pressure applying mechanisms 7 is provided in the axial direction of the elastic rotating rolls 6. Each of the pressure applying mechanism 7 is operated on the outside of the side plate 3a of the furnace wall 3 to apply pressure from within the furnace through the seal sheet 4 so that only the required portion of the elastic seal pad 5 is urged toward the elastic rotating roll 6. This mechanism 7 includes: a holder 7a that is threadedly engaged with an internally threaded portion of a sleeve 3c fixed on the outside of a portion of the side plate 3a of the furnace wall 3 including a through-hole 3b and is internally threaded at the end spaced away from the through-hole 3b; a pressure applying member 7b that is inserted through the holder 7a into the through-hole 3b in the side plate 3a of the furnace wall 3 to apply pressure from within the furnace directly to the seal sheet 4 or to apply pressure to a projecting member 7e of a pressure applying plate 7g that is pivotally supported by a hinge 7f on the seal sheet 4; a coil spring 7c that is likewise inserted through the holder 7a for forcing an intermediate stepped portion of the pressure applying member 7b in the furnace; and a bolt 7d that is threadedly engaged with the internal thread provided on the inner surface of the holder 7a spaced away from the through-hole 3b for urging the coil spring 7c toward the furnace.

The thus constructed seal assembly is used on the entrance and exit of the heat treating furnace in which the hydrogen gas-containing gas atmosphere is used in order to carry out the sealing method thereof, which is as described hereafter. The seal assembly 2 includes: the seal sheets 4, each sheet being fixed at one end to the side plate 3a of the furnace wall 3 and supported in place with flexibility; the elastic seal pads 5, each pad being fixed to the surface of the seal sheet 4; and the elastic rotating rolls 6 held by furnace wall 3 positioned on both widthwise sides of the metallic strip S, each roll being engaged with the elastic seal pad 5 and the metallic strip S for sealing up the furnace. In sealing up the furnace gas of the seal assembly, whether or not the furnace gas leaks out of the portion of sealing contact of the elastic seal pad 5 with the elastic rotating roll 6 is first visually observed or inspected by reading a furnace pressure meter.

Then, when there is gas leakage from between the elastic seal pad 5 and the elastic rotating roll 6, the pressure applying mechanism 7 located at the position where the gas leakage is found is operated on the outside of the side plate 3a of the furnace wall 3 to apply pressure to the pressure applying member 7b, so that the pressure can be applied from within the furnace to the elastic seal pad 5 through the seal sheet 4, thereby urging only the required portion of the seal pad 5 against the elastic rotating roll 6. This in turn causes the elastic seal pad 5 to be deformed so that only the gas leaking portion between the elastic seal pad 5 and the elastic rotating roll 6 can exclusively be sealed up.

Referring now to this operation with reference to FIG. 2, the bolt 7*d* of the pressure applying mechanism 7 located at the gas leaking position and on the outside of the side plate 3*a* of the furnace wall 3 is turned to move the externally threaded portion of the bolt 7*d* toward the through-hole 3*b* formed in the side plate 3*a* of the furnace wall 3 in the holder 7*a*. Alternatively, the holder 7*a* threadedly engaged with the inner surface of the sleeve 3*c* is turned by itself and thereby moved toward the through-hole 3*b*. Whereupon, the coil spring 7*c* is so compressed that the pressure applying member 7*b* inserted into the through-hole 3*b* can apply pressure directly to the seal sheet 4 within the furnace or to the projecting member 7*e* of the pressure applying plate 7*g* pivotally supported by the hinge 7*f* of the inner side of the furnace on the seal sheet 4. The thus pressurized seal sheet 4 then causes only the required portion of the elastic seal pad 5 to be forced against the elastic rotating roll 6, whereby the gas leaking portion between the elastic seal pad 5 and the elastic rotating roll 6 can be sealed up. In the arrangement, the pressure applying plate 7*g* applies pressure to the seal plate 4 all over the portion of contact with the elastic seal pad 5 with the elastic rotating roll 6, or over a part of that portion that is displaced nearer to the side plate 3*a* of the furnace wall 3, or over a portion where the elastic seal pad 5 does not contact the elastic rotating roll 6.

In the arrangement shown in FIG. 2, since the sleeve 3*c* fixed on the portion of the outside of the furnace that includes the through-hole 3*b* formed through the side plate 3*a* of the furnace wall 3 and the holder 7*a* is sealed by their threadedly engaged portions and since the holder 7*a* and the bolt 7*d* are again sealed by their threadedly engaged portions, the furnace gas, even if it should enter the holder 7*a* through between the through-hole 3*b* formed through the side plate 3*a* of the furnace wall 3 and pressure applying member 7*b*, is unlikely to leak out of the pressure applying mechanism 7.

The elastic seal pad 5 may have a uniform thickness as shown in FIG. 2, or it may vary locally in thickness so as to increase the surface length of contact thereof with the elastic rotating roll 6 as shown in FIG. 4. In either embodiment, it is preferable that the elastic seal pad 5 includes a segment having a radius of curvature substantially equal to the diameter of the drum of the elastic rotating roll 6, with the portion of contact of the segment with the elastic rotating roll 6 being 1/15 or longer of the peripheral length of the elastic rotating roll 6. This is because the length of contact of the elastic seal pad 5 with the periphery of the elastic rotating roll 6 is so increased that the effect on sealing up the furnace gas can be enhanced by an increased flow resistance of the furnace gas. In the arrangement, the elastic seal pad 5 has a relatively large thickness and so possesses rigidity by itself. To transmit the pressure of each pressure applying mechanism 7 easily to the elastic seal pad 5, therefore, it is preferable that the side of the seal sheet 4 that applies pressure to the elastic rotating roll 6 is slit or cut through in the direction perpendicular to the axial direction of the elastic rotating roll 6 corresponding to each pressure applying mechanism 7. Furthermore in this arrangement, it is preferable that two or more sets of pressure applying mechanism 7 are provided in the peripheral direction of the elastic rotating roll 6.

By use of such pressure applying mechanism 7, it is possible to prevent gas leakage between the elastic seal pad 5 and the elastic rotating rolls 6 in the seal assembly 2 located at the entrance and exit sides of the heat treating furnace. Thus, since the amount of furnace gas leakage can be reduced, it is possible to reduce the consumption of the atmosphere gas and hence achieve some considerable cost reduction. A risk of explosion or causing a fire due to gas leakage can also be greatly reduced. This arrangement is easily applicable to a tapered or crown form of rolls of different diameters as disclosed in Japanese Patent Laid-Open No. 2-54723.

The pressure applying mechanism 7, because of its relatively simple in structure, can be manufactured inexpensively and easily. Therefore, the method of the present invention can immediately be practiced by attaching the mechanisms 7 to an existing seal assembly used with a heat treating furnace which is operated using a gas atmosphere containing hydrogen gas. Furthermore, the above effect becomes more reliable, if the seal sheet 4 is of an integrally continuous structure that it is fixed at one end to the side plate 3*a* of the furnace wall 3 and supported in place by flexibility, or of a structure that only its side applying pressure to the elastic rotating roll 6 through the elastic seal pad 5 is slit in the direction perpendicular to the axial direction of each elastic rotating roll 6 corresponding to each pressure applying mechanism 7, or of a structure that its side applying pressure to the elastic rotating roll 6 through the elastic pad sheet 5 is sectioned through in the direction perpendicular to the axial direction of the elastic rotating roll 6 corresponding to each pressure applying mechanism 7.

Preferably, the surface of the elastic seal pad 5 of the seal assembly 2 is formed of a material having an LOI value of 26 or more. Even when a fire is caused by the ignition of a gas having atmospheric air mixed with the hydrogen-containing furnace gas leaking out of the furnace, the fire can be extinguished within a relatively short time by feeding nitrogen gas in the seal assembly 2 housed in the furnace or spraying carbonic acid gas onto the seal assembly 2 from fire extinguishing equipment additionally attached to the seal assembly 2. The elastic seal pad 5 is thus unlikely to be scorched, melted or denatured. This enables the heat treating furnace to be resumed immediately upon extinguishment of the fire, because the ability of the seal assembly to prevent gas leakage is maintained with neither contamination of, or damage to, the elastic rotating roll 6.

More specifically, polyphenylene sulfide fibers forming the surface of the elastic seal pad 5 have a melting point of 285° C. Aramid fibers, i.e., para- and meta-aromatic aramid fibers are decomposed at 415° C. and 371° C., respectively, for self extinguishment, while carbon fibers remain inactivated at 300° C. or lower. The non-woven fabric 5*a* comprising these polyphenylene sulfide fibers, aramid fibers, aramid and carbon fibers, polyphenylene sulfide and aramid fibers, or polyphenylene sulfide, aramid and carbon fibers, all having an LOI value of 26 or more, has sufficient heat resistance and not suffer from denaturalization even when a small fire is caused in the vicinity of the elastic seal pad 5. As is known, chloroprene rubber, chlorosulfonated polyethylene, chlorinated polyethylene, hydrin rubber, silicone rubber or fluororubber forming the outer surface of the elastic rotating roll 6 are of sufficient heat resistance. Thus, the outer surface of the elastic rotating roll 6 is neither melted nor damaged even when a small fire of at most about 10 seconds is caused around the elastic seal pad 5. The fibers used, if they have an LOI value less than 26, are severely damaged by melting or burning on fire due to their low self-extinguishing properties, and so are unsuitable for the surface of the elastic rotating roll. On fire, the heat treating furnace must be shut down over as long as several days for the replacement of the elastic seal pad 5 although depending on furnace type, for instance, because the furnace gas must be replaced by nitrogen gas.

The elastic seal pad 5, when the overall pad including its surface through the seal sheet 4 applied on its back is formed of the non-woven fabric 5*a* comprising the above-described polyphenylene sulfide fibers, aramid fibers, aramid and carbon fibers, polyphenylene sulfide and aramid fibers, or polyphenylene sulfide, aramid and carbon fibers, offers no problem in terms of heat resistance. However, the non-woven fabric 5*a* is of permeability and so is inferior in terms of the ability to prevent gas leakage. Therefore, it is preferable that the substantial portion 5*b* of the elastic seal pad is formed of a less permeable material having a hardness of 10 to 50 as measured according to JIS S6050, for instance, NBR sponge, EPDM sponge, chloroprene rubber sponge, chlorosulfonated polyethylene sponge, chlorinated polyethylene sponge, hydrin rubber sponge, silicone rubber sponge or fluororubber sponge, and that the non-woven fabric 5*a* comprising the above-described polyphenylene sulfide fibers, aramid fibers, aramid and carbon fibers, polyphenylene sulfide and aramid fibers, or polyphenylene sulfide, aramid and carbon fibers is laminated or otherwise attached to only the surface (surface layer portion) of the elastic seal pad 5 that comes into direct contact with the elastic rotating roll 6. To achieve improved sealing properties, it is preferable that the substantial portion 5*b* of the elastic seal pad 5 being made of NBR sponge, EPDM sponge, chloroprene rubber sponge, chlorosulfonated polyethylene sponge, chlorinated polyethylene sponge, hydrin rubber sponge, silicone rubber sponge or fluororubber sponge is formed of a closed cell sponge material having its air permeability as reduced as possible; that is, it is only the surface of the elastic seal pad 5 to come into contact with the elastic rotating roll 6 that has air permeability with the rest being of no air permeability. By doing this, it is not only possible to reduce the consumption of costly atmospheric gases but also possible to prevent entrance of air, so that the metallic strip S can be free from coloration due to surface oxidation and so improved in quality. Damage on fire can be reduced as well.

In the elastic seal pad 5, the NBR sponge, EPDM sponge, chloroprene rubber sponge, chlorosulfonated polyethylene sponge, chlorinated polyethylene sponge, hydrin rubber sponge, silicone rubber sponge or fluororubber sponge 5*b* sandwiched between the seal plate 4 and the surface non-woven fabric 5*a*. As mentioned, the sponge 5*b* should preferably have a hardness of 10 to 50 as measured according to JIS S6050. A sponge material having a hardness less than 10 or less is too soft to transmit the force for sufficiently sealing the surface asperities of the elastic rotating roll 6 to the non-woven fabric 5*a*, and makes the rigidity of the elastic seal pad 5 too insufficient to prevent gas leakage. A sponge material having a hardness exceeding 50 as measured according to JIS S6050 is of too high rigidity; in other words, it is lacking in flexibility enough to conform to the surface asperities of the elastic rotating roll 6 or it is locally pressed against the elastic rotating roll 6 to damage the surface thereof. Furthermore, the fibers of the surface layer portion are frizzled up or fall out. The sponge material having a hardness of 10 to 50, because of having suitable flexibility, is uniformly pressed against the elastic rotating roll 6 and so does not do damage the surface thereof, and the surface of the elastic rotating roll 6 is not frizzled or do not fall out. At the next rolling step, therefore, the metallic strip S can be treated with no dent thereon; so the strip product of good surface quality can be obtained.

The elastic seal pad 5 may be formed of the non-woven fabric 5*a* with or without the NBR sponge, EPDM sponge, chloroprene rubber sponge, chlorosulfonated polyethylene sponge, chlorinated polyethylene sponge, hydrin rubber sponge, silicone rubber sponge or fluororubber sponge 5*b* between the seal plate 4 and the surface of the non-woven fabric 5*a*. In either case, it is preferable that, as shown in FIGS. 2 and 4, the elastic seal pad 5 includes a segment having a radius of curvature substantially equal to the diameter of the drum of the elastic rotating roll 6, with the portion of contact of the segment with the elastic rotating roll 6 being 1/15 or longer of the peripheral length of the elastic rotating roll 6. This is because the length of contact of the elastic seal pad 5 with the periphery of the elastic rotating roll 6 is so increased that the effect on sealing up the furnace gas can be enhanced owing to an increased flow resistance of the furnace gas. Furthermore in this case, since the portion of contact of the surface of the elastic seal pad 5 with the elastic rotating roll 6 behaves as if it were a labyrinth packing, the effect on preventing gas leakage is much more enhanced by large gas pressure losses. The smaller the amount of gas leakage, the smaller the intensity of flames induced by a fire and so the larger the durability or the lesser the damage. When the elastic seal pad 5 has such structure as above mentioned, it is not always required to provide a plurality of pressure applying mechanisms 7 in the axial direction of the elastic rotating roll 6. This is because the elastic seal pad 5 produces uniform pressure owing to its elasticity to achieve considerable improvement in the effect on preventing gas leakage and is well resistant to flames, and so is practically usable.

The elastic rotating roll 6 comprises the roll drum 6*a* the outer surface of which comes in contact with the metallic strip S and is formed of chloroprene rubber, chlorosulfonated polyethylene, chlorinated polyethylene, hydrin rubber, silicone rubber or fluororubber; a set of two or more slip disks 6*b* between the both sides of the furnace wall 3 made of synthetic material composed predominantly of heat and flame resistant fluororesin having an electrical receptivity value on the slip surface of 1 to 10Ω·cm; or a rotating disk 6*d* having a bearing; and an elastic disk 6*c* having an electrical receptivity value of 1 to $10^7$Ω·cm of resistant flame properties and formed of chloroprene rubber, chlorosulfonated polyethylene, chlorinated polyethylene, hydrin rubber, silicone rubber or fluororubber. In such arrangements, the transmission of rotatory force between the end of the roll drum 6*a* and the furnace wall 3 is cut off and the furnace wall 3 and/or the end of the elastic rotating roll 6 are unlikely to wear away, so the sealing properties will not decrease. Furthermore, no fire due to sparks is caused because of no generation of static electricity due to continuous rotational friction on the end of the elastic rotating roll 6. Even when a fire is caused by refractory or other debris, the fire can be immediately extinguished owing to the flame and heat resistance of the elastic rotating roll 6, etc., with no damage by burning and melting at all, the sealing properties thereof not being affected and thus becoming safe, the fire being not spread.

POSSIBLE UTILIZATION IN INDUSTRY

According to the seal method and assembly of the present invention which, as described above, are applied to the entrance and exit sides of a heat treating furnace with a gas atmosphere containing hydrogen gas prevailing therein, portions from which furnace gas leakage occurs through between the elastic seal pads and the elastic rotating rolls can be exclusively sealed up, so that the amount of furnace gas leakage can be reduced. This gives rise to cost reductions owing to a reduction in the consumption of the atmosphere gas, and reduces considerably the risk of igniting the leaking furnace gas, resulting in explosion and fires. If at least the surfaces of the elastic seal pads forming part of the seal assembly is formed of a heat-resistant material, the elastic seal pads suffer from no denaturalization or melting even when the leaking furnace gas is ignited to cause a fire such as one capable of being put out within a short period of time. Thus, the elastic seal pads can maintain their own sealing effect, and is unlikely to contaminate the surfaces of the elastic rotating rolls. Moreover, if the elastic rotating rolls are formed of a heat-resistance material, the elastic rotating rolls forming a part of the seal assembly suffer from no denaturalization or melting even when the leaking furnace gas is ignited to cause a fire such as one capable of being put out within a short period of time, so that the elastic rotating rolls can maintain their own sealing effect. Thus, damage due to fires can be substantially reduced; so making it possible to operate the heat treating furnace with a gas atmosphere containing hydrogen gas in a stable manner. The present invention is therefore of great value in industry.

What is claimed is:

1. A method for sealing an entrance and an exit of a heat treating furnace for a metal strip using a furnace gas containing hydrogen gas and having a seal assembly located at the entrance and exit, said seal assembly including a seal sheet fixed at one end to a side plate of a furnace wall to be supported in place with flexibility, an elastic seal pad fixed to a surface of the seal sheet, and an elastic rotating roll held by the furnace wall at both sides thereof and pressed against the elastic seal pad and the metallic strip to prevent gas leakage, wherein a plurality of pressure applying mechanisms is provided on the furnace wall parallel to the elastic roll, each of the pressure applying mechanisms being independently operated from an outside of the furnace wall to locally apply pressure to the elastic seal pad through the seal sheet in the furnace by a pressure applying member so that only a required portion of the elastic seal pad is urged toward the elastic rotating roll to thereby seal a gas leakage portion between the elastic seal pad and the elastic rotating roll; a surface of the elastic seal pad is formed of a material having a limit oxygen index LOI of 26 or more; and the elastic seal pad has as a whole a hardness of 10 to 50 as measured according to JIS S6050.

2. The method for sealing according to claim 1, wherein each pressure applying member of the pressure applying mechanism applies pressure from inside said furnace to a portion of said seal sheet, which is located above a contact portion of said elastic seal pad with said elastic rotating roll.

3. The method for sealing according to claim 1, wherein each pressure applying member of the pressure applying mechanism applies pressure from inside said furnace to a portion of said seal sheet, which is spaced for a predetermined distance toward the side plate of the furnace wall from a contact portion of said elastic seal pad with said elastic rotating roll.

4. A seal assembly located on entrance and exit sides of a heat treating furnace for a metallic strip, comprising:

a housing having a furnace wall and a side plate, said side plate having through-holes and a plurality of sleeves surrounding the through-holes and located outside the housing;

a seal sheet fixed at one end to the side plate and supported in place with flexibility;

an elastic seal pad fixed to a surface of the seal sheet;

an elastic rotating roll held by the furnace wall at longitudinal ends and pressed against the elastic seal pad and a metallic strip to be treated, said elastic seal pad having a surface formed of a material with a limit oxygen index LOI of 26 or more and a hardness as a whole of 10 to 50 as measured according to JIS S6050; and a plurality of pressure applying mechanisms attached to the side plate, each pressure applying mechanism including a holder fixed to each sleeve of the furnace wall and having an internal thread at a portion away from the side plate; a pressure applying member situated in the holder and having an intermediate stepped portion, said pressure applying member passing through one through-hole of the furnace wall and applying pressure to the seal sheet in the furnace; a coil spring situated in the holder for urging the intermediate stepped portion of the pressure applying member to the furnace; and a bolt threadably engaging the internal thread of the holder located away from the through-hole for urging the coil spring toward the furnace.

5. The seal assembly according to claim 4, wherein a outer surface of said elastic rotating roll is formed of chloroprene rubber, chlorosulfonated polyethylene, chlorinated polyethylene, hydrin rubber, silicone rubber or fluororubber.

6. The seal assembly according to claim 4, wherein said elastic rotating roller includes between the furnace wall and the drum portion a set of at least two slip disks formed of a synthetic material composed predominantly of fluororesin or a rotating disk having a bearing and an elastic disk formed of chloroprene rubber, chlorosulfonated polyethylene, chlorinated polyethylene, hydrin rubber, silicone rubber or fluororubber.

7. The seal assembly according to claim 6, wherein said slip disks have an electrical resistivity of at least 1 to $10^7$ Ω·cm on the slip surfaces and said elastic disk has an electrical resistivity of 1 to $10^7$ Ω·cm.

8. The seal assembly used according to claim 4, wherein said seal pad includes a surface portion of the elastic seal pad formed of a non-woven fabric comprising polyphenylene sulfide fibers, aramid fibers, aramid and carbon fibers, polyphenylene sulfide and aramid fibers, or polyphenylene sulfide, aramid and carbon fibers.

9. The seal assembly according to claim 8, wherein said elastic material forming said elastic seal pad is NBR sponge, EPDM sponge, chloroprene rubber sponge, chlorosulfonated polyethylene sponge, chlorinated polyethylene sponge, hydrin rubber sponge, silicone rubber sponge or fluororubber sponge.

10. The seal assembly according to claim 9, wherein said NBR sponge, EPDM sponge, chloroprene rubber sponge, chlorosulfonated polyethylene sponge, chlorinated polyethylene sponge, hydrin rubber sponge, silicone rubber sponge or fluororubber sponge (5*b*) forming said elastic seal pad is a sponge of a closed cell structure of less air permeability.

11. The seal assembly according to claim 4, wherein said elastic seal pad is formed of a non-woven fabric fixed directly to a surface of said seal sheet and comprising polyphenylene sulfide fibers, aramid fibers, aramid and carbon fibers, polyphenylene sulfide and aramid fibers, or polyphenylene sulfide, aramid and carbon fibers.

12. The seal assembly according to claim 4, wherein a portion of contact of the surface of said elastic seal pad with said elastic rotating roll has a segment having a radius of curvature substantially equal to a diameter of a roll drum portion of said elastic rotating roll.

13. The seal assembly according to claim 4, wherein said each pressure applying mechanism further includes a pressure applying plate pivotally attached to the side plate of the furnace wall and disposed on the seal sheet, and a projecting member fixed onto the pressure applying plate, said pressure applying member abutting against the projecting member to apply pressure to the seal sheet.

14. The seal assembly according to claim 4, wherein said pressure applying mechanism applies pressure to the seal plate on an entire contact location of the elastic seal pad with the elastic rotating roll.

15. The seal assembly according to claim 4, wherein said pressure applying mechanism applies pressure to the seal sheet between a contact portion of the elastic seal pad with the elastic rotating roll and the side plate of the furnace wall.

16. The seal assembly according to claim 4, wherein said seal sheet is a single sheet without a slit and a cut-through section in a direction perpendicular to an axial direction of the elastic rotating roll.

17. The seal assembly according to claim 4, wherein said seal sheet has a first side integrally formed without a slit, a second side opposite to the first side and applying pressure to the elastic rotating roll through the elastic seal pad, and a plurality of slits in a direction perpendicular to an axial direction of the elastic rotating roll to correspond to each pressure applying mechanism.

18. The seal assembly according to claim 4, wherein said seal sheet is cut entirely from one side to the other side in a direction perpendicular to an axial direction of the elastic rotating roll to correspond to each pressure applying mechanism.

19. The seal assembly according to claim 4, wherein said seal sheet is formed of a metal or synthetic resin material.

20. The seal assembly according to claim 4, wherein a surface contact portion of the elastic seal pad with the elastic rotating roll includes a segment having a radius of curvature substantially equal to a diameter of the elastic rotating roll, said surface contact portion having at least 1/15 of a peripheral length of the elastic rotating roll.

* * * * *